US005708992A

United States Patent [19]

Gobbers et al.

[11] Patent Number: 5,708,992

[45] Date of Patent: Jan. 20, 1998

[54] DEVICE FOR PLACEMENT IN A BATHTUB OR SIMILAR STRUCTURE AS AN ENTERING AND EXITING AID

[76] Inventors: Walter Gobbers; Dieter Gobbers, both of Bruderstrasse 11, 89415 Lauingen, Germany

[21] Appl. No.: 545,541

[22] Filed: Oct. 19, 1995

[30] Foreign Application Priority Data

Oct. 20, 1994 [DE] Germany ..... 44 37 513.1

[51] Int. Cl.[6] ..... A47K 3/12

[52] U.S. Cl. ..... 4/565.1; 4/578.1; 297/DIG. 10; 297/378.12; 297/344.17

[58] Field of Search ..... 4/560.1, 559, 561.1, 4/564.1, 565.1, 578.1, 579, 667; 297/DIG. 10, 378.12, 344.15, 344.17

[56] References Cited

U.S. PATENT DOCUMENTS

| | | | |
|---|---|---|---|
| 2,620,020 | 12/1952 | Austin | 297/344.15 |
| 2,968,814 | 1/1961 | Ashby, Jr. | 4/564.1 |
| 3,400,410 | 9/1968 | Salinger | 4/564.1 |
| 4,034,426 | 7/1977 | Hardwick et al. | 4/564.1 |
| 4,574,408 | 3/1986 | Dentler et al. | 4/560.1 |
| 4,932,087 | 6/1990 | Schmidt | 4/560.1 |
| 5,323,497 | 6/1994 | Lih et al. | 4/564.1 |

FOREIGN PATENT DOCUMENTS

| | | | |
|---|---|---|---|
| 3701080 | 7/1988 | Germany | 297/344.17 |
| 5-285183 | 11/1993 | Japan | 4/565.1 |

*Primary Examiner*—Henry J. Recla
*Assistant Examiner*—Charles R. Eloshway
*Attorney, Agent, or Firm*—Randall J. Knuth

[57] ABSTRACT

Disclosed is a device for placement in a bathtub or the like as an entering and exiting aid. A seat with a backrest and base includes a seat panel that can be raised and lowered. A drive is used for raising and lowering the seat panel with an actuator arranged between drive and seat panel. The actuator includes a stay that attaches to the seat panel and allows downward extension so as to bear on a bearing surface, for example a base of the device, thus effecting a raising of the seat panel that matches its extension.

11 Claims, 11 Drawing Sheets

DEVICE FOR PLACEMENT IN A BATHTUB OR SIMILAR STRUCTURE AS AN ENTERING AND EXITING AID

BACKGROUND OF THE INVENTION

1. Field of the Invention

The present invention relates to a device for placement in a bathtub or similar structure as an aid in entering and exiting.

2. Description of the Related Art

Devices for placement in a bathtub or similar structure for lifting or lowering are helpful or indispensable for older or frail persons They enable a safe and convenient entering and exiting to and from, respectively, a bathtub, vat or the like. The basic structure has a seat panel. The seat panel is generally supported by a scissor frame whose linkages are adjustable, effecting thereby an alteration of the seat panel level. There are several options also as regards the drive, which may be by electric motor, pneumatic power, or may utilize the pressure of the municipal water supply system.

Prior devices have proved themselves more or less, but weaknesses continue to be shortcomings in safety, excessive weight and limited operating comfort.

What is needed in the art is a device in the field of the invention to boost the safety and operating comfort while reducing the weight of the device.

SUMMARY OF THE INVENTION

The present invention provides a device for placement in a bathtub or the like as an entering and exiting aid. A seat with a backrest and base includes a seat panel that can be raised and lowered. A drive is used for raising and lowering the seat panel with an actuator arranged between the drive and seat panel. The actuator includes a stay that attaches to the seat panel and allows downward extension so as to bear on a bearing surface, for example a base of the device, thus effecting a raising of the seat panel that matches its extension.

The invention comprises, in one form thereof, a device for placement in a bathtub or the like as an entering and exiting aid. The device includes a seat having a seat panel that can be raised and lowered, a backrest connected to the seat, and a a drive for raising and lowering the seat panel. An actuator is arranged between the drive and the seat panel, the actuator including a stay which is attachable to the seat panel and which is extendable downwardly from the seat panel so as to bear on a bearing surface, thereby effecting a raising of the seat panel that substantially matches the extension.

An advantage of one form of the invention is constituted by the possibility of arranging the motor on the backrest or even in its upper area, so that the motor is removed or distanced maximally from the water-level in the tub.

BRIEF DESCRIPTION OF THE DRAWINGS

The above-mentioned and other features and advantages of this invention, and the manner of attaining them, will become more apparent and the invention will be better understood by reference to the following descriptions of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
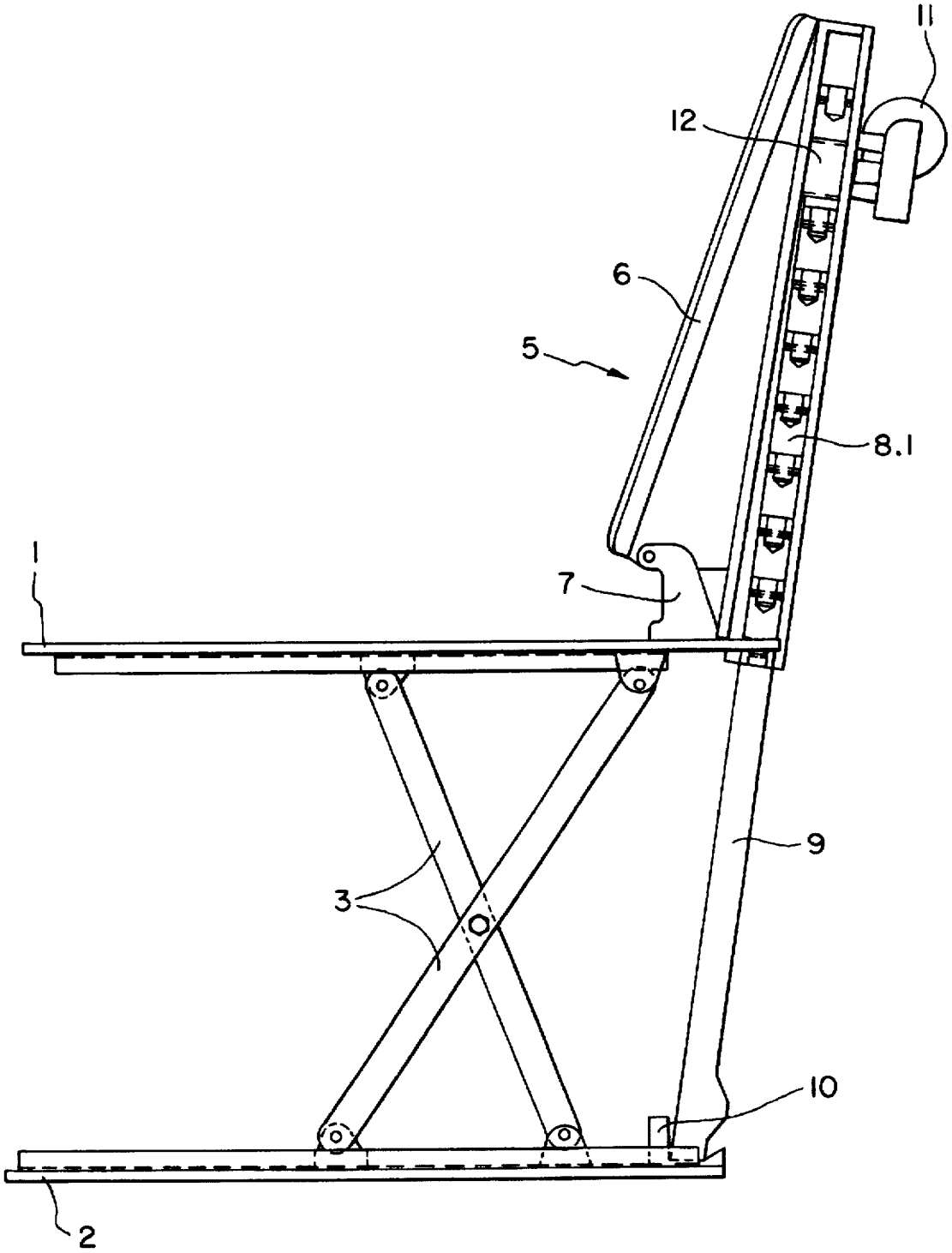
FIG. 1 is a side elevational view of one form of the present invention.

The invention is more fully explained with the aid of the drawings. FIG. 1 shows a seating device in side elevation. Visible are the seat panel 1 and a base 2. They are joined by means of a scissor frame 3. Located in the front area, on the top side of the seat panel, are two push-buttons which allow the user to control raising and lowering of the seat panel.

An element of the invention is a backrest assembly 5 comprised of several components. The assembly 5 features a backrest 6 with a structure similar to that of seat panel 1. Contained on the back of the backrest 6 is a mechanism that contains elements of the invention, which are visible particularly well in FIGS. 2, 4 and 5.

Figure 2:
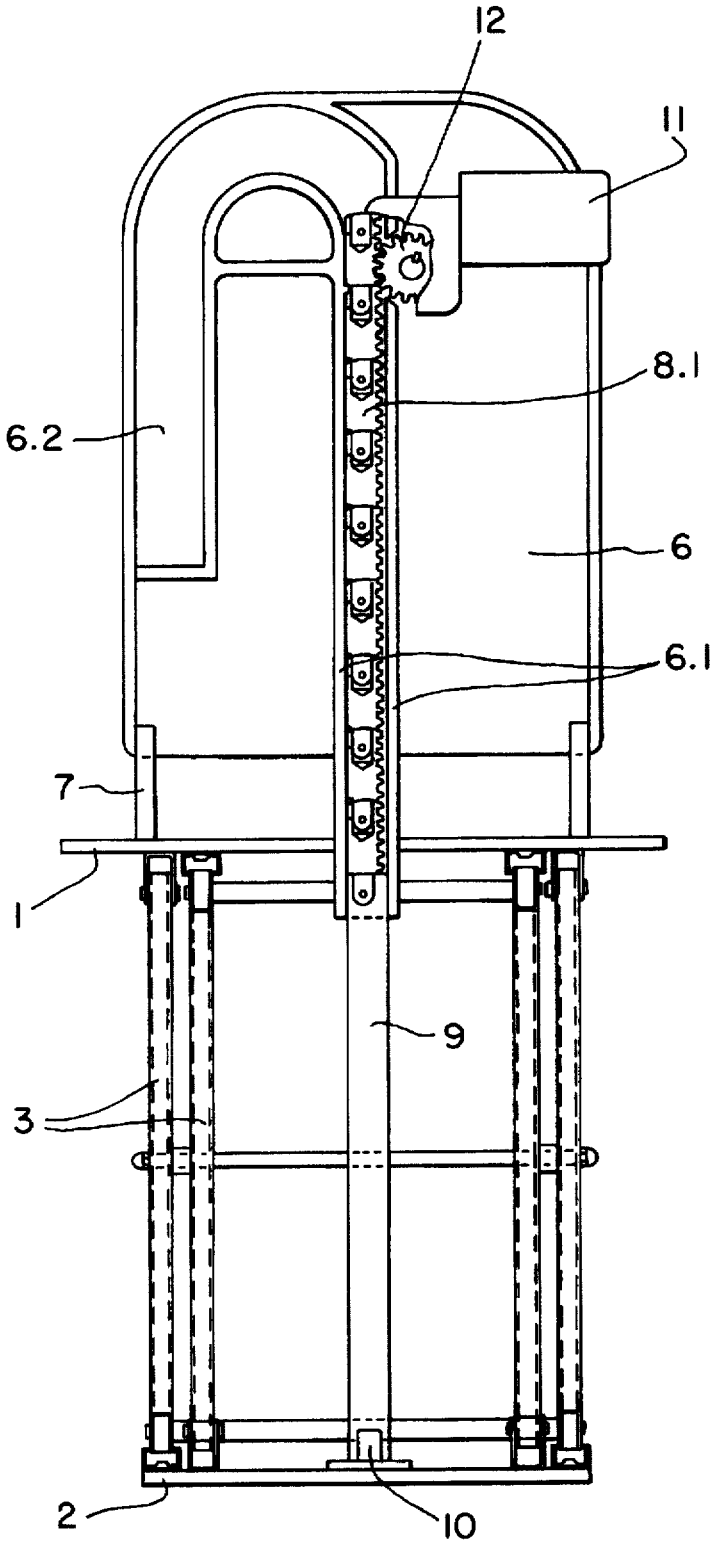
FIG. 2 is a rear elevational view of the invention of FIG. 1.

FIG. 2 is a rear view of the seating device in a usable state. As can be seen, a guide channel 6.1 extends into a further channel 6.2, these two channels having jointly at least approximately the shape of a cane. Contained in the guide channel 6.1 is a rack 8 structured of a plurality of rack segments 8.1. The rack segments 8.1 are articulated and run, for one, in the guide channel 6.1 and, for another, in the channel 6.2, which hereafter will be called the "rack channel."

Figure 5:
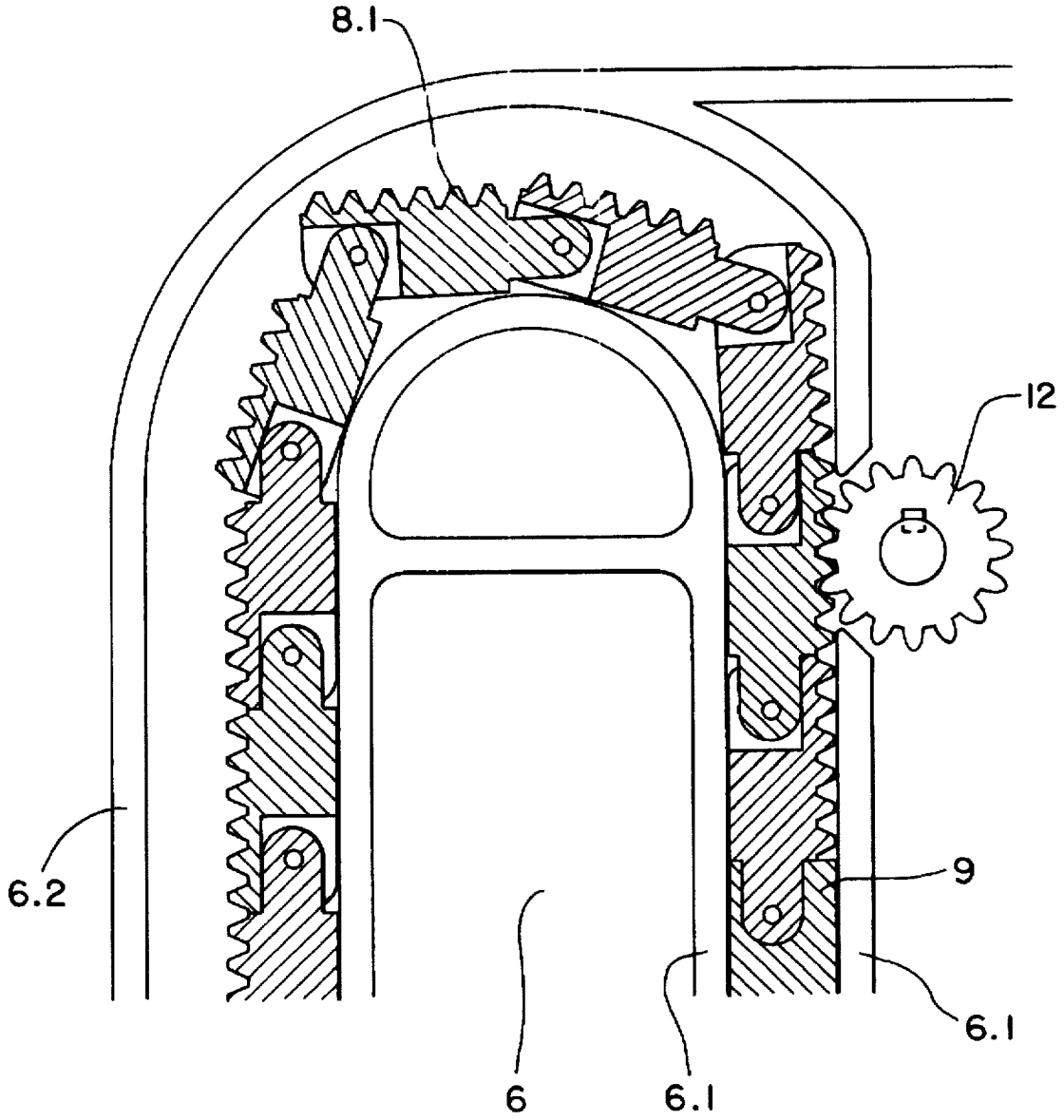
FIG. 5 is an enlarged partial view of the rack utilized in the invention.

FIG. 5 is an enlarged partial view of the subject of FIG. 2, showing structural details of rack 8. As can be seen, a pinion 12 is provided, the teeth of which mesh with the teeth of rack segments 8.1. The rack 8 is thereby slidably movable in the guide channel 6.1 as well as in the rack channel 6.2, and is able to follow the channel curvature in the upper area of assembly 5.

Visible again in FIGS. 1 and 2, it can be seen that a stay 9 attaches to the bottom end of the rack 8. A displacement of the rack 8 in channels 6.1 and 6.2 causes thus also a downward or upward movement of stay 9 relative to channel 6.1.

Figure 3:
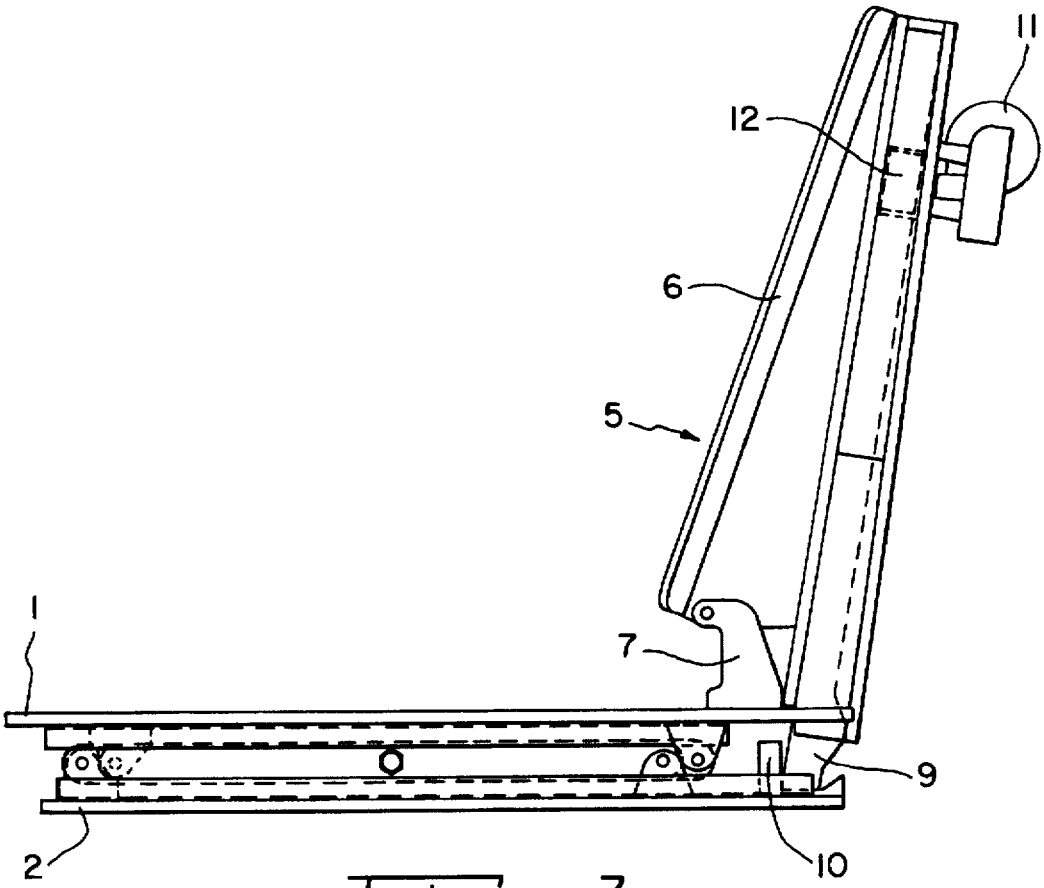
FIG. 3 is a side elevational view of the invention of FIG. 1 shown in the collapsed state.
Figure 4:
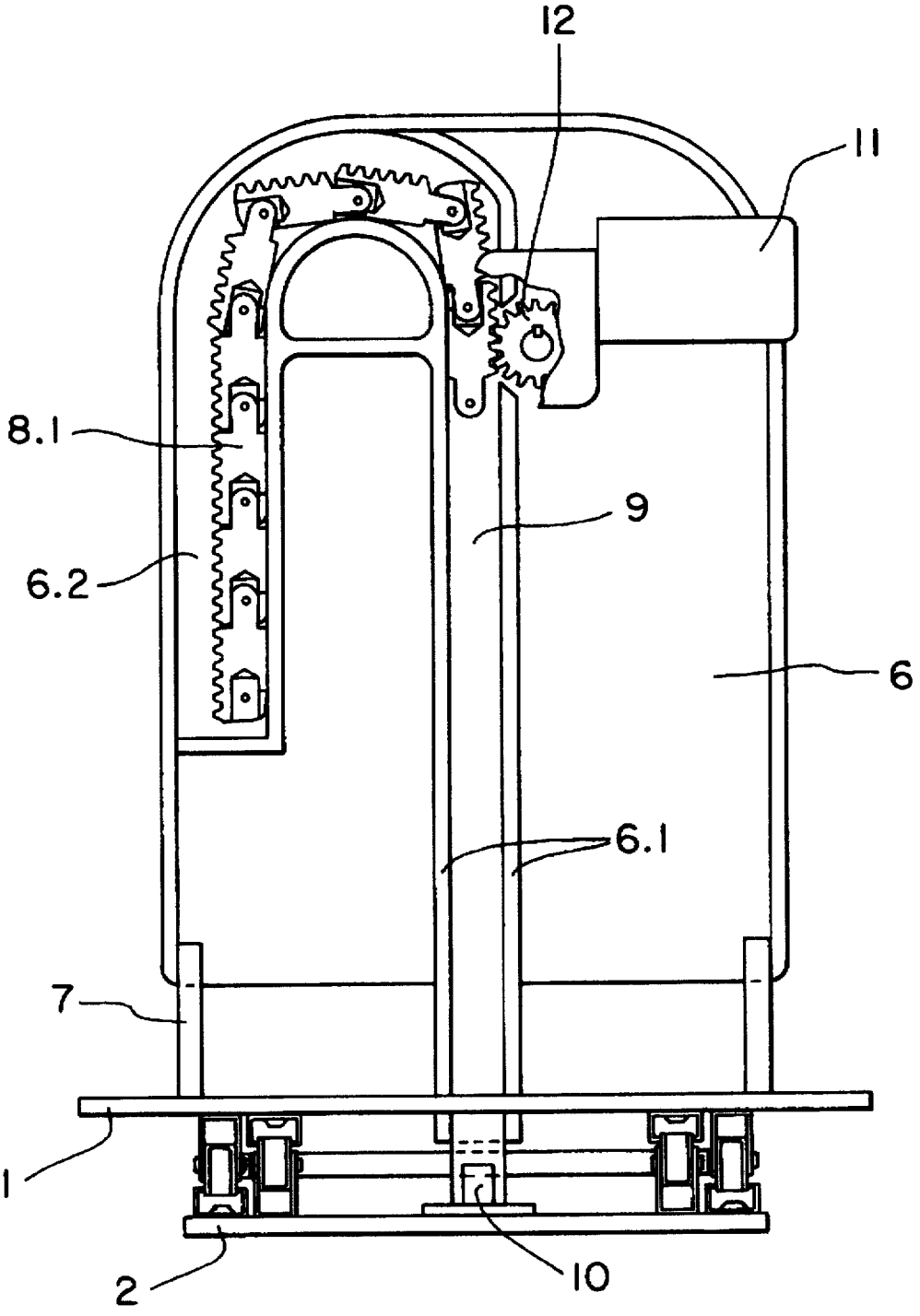
FIG. 4 is a rear elevational view of the invention of FIG. 1 shown in the collapsed state.

FIGS. 3 and 4 show the seating device with the scissor frame 3 collapsed. Seat panel 1 and base 2 are in this state as closely adjacent as the structure will allow. The rack 8 is now contained entirely in the rack channel 6.2, and the stay 9 completely in the guide channel 6.1.

In operation, the seating device of the present invention operates in the following way. As pinion 12 is driven counterclockwise by the gearmotor 11, as shown with the seating device in a state illustrated in FIG. 3 and 4, the rack 8 is put in motion, and at that, in a fashion such that its right-hand end, in FIG. 4, is pushed down. Due to the connection between the rack 8 and stay 9, the stay 9 is forced down as well. This action exerts a pressure on base 2, causing the backrest assembly 5, and thus also of the seat panel 1 joined firmly to it, to be raised. This action continues until the device reaches that state illustrated in FIGS. 1 and 2.

To lower the seat panel 1 (and with it of necessity also backrest assembly 5), the gearmotor 11 is operated in reverse, causing pinion 12 to rotate clockwise. The rack 8 gradually enters the rack channel 6.2, while stay 9 increasingly disappears in the guide channel 6.1.

Figure 6:
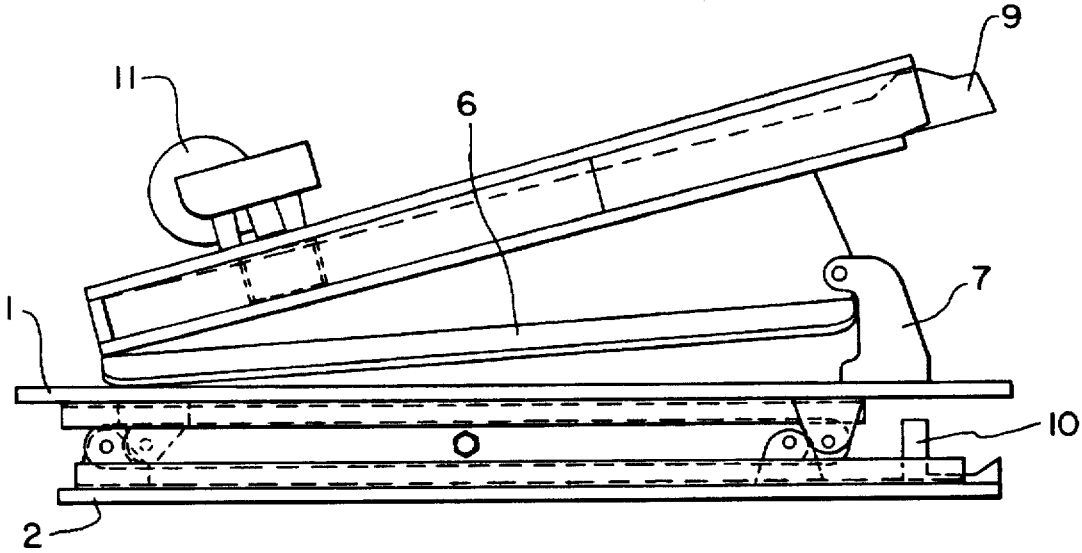
FIG. 6 is a side elevational view of the invention of FIG. 1 shown moving toward its folded state.

When the seating device is in the state as shown in FIGS. 3 and 4, the back rest assembly 5 can be folded over, producing the state illustrated in FIG. 6. The seating device has now been collapsed to a relatively small and handy packet. With an appropriately low weight, the device can be transported easily. Such may be important, when handicapped or older people travel.

According to the invention, the necessary safety is also assured in the operation of the seating device by the following design. To begin with, special construction measures safeguard that stay 9 remains during both retraction and extension exactly and reliably in the position which it is supposed to assume in retraction and extension. Observed, thus, is exactly the angle at which stay 9 is oriented in the positional states according to FIGS. 1 and 2 as well as 3 and 4, in relation to the base 2.

Figure 7:
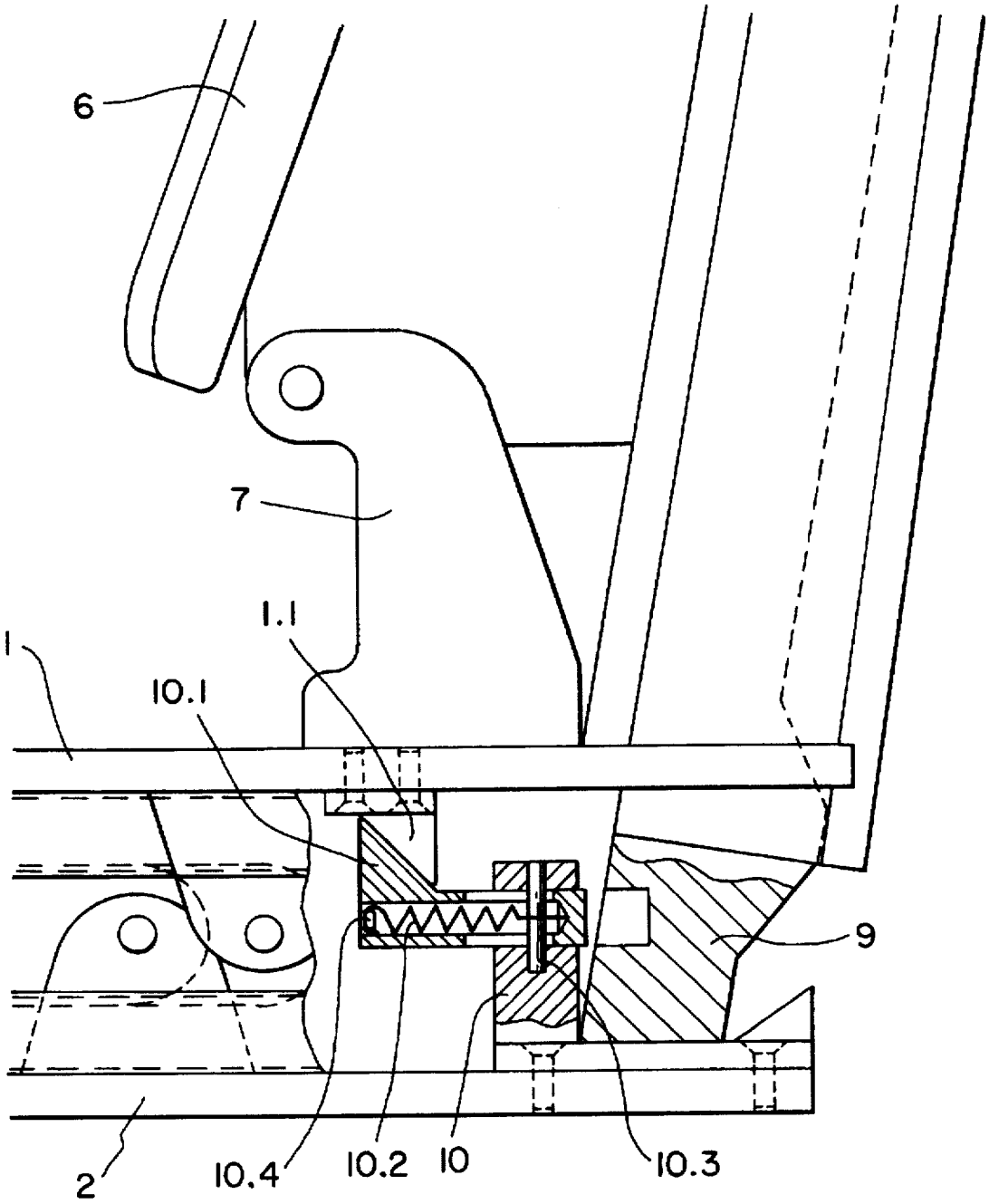
FIG. 7 is an enlarged view of an embodiment of a safety device of the invention.

The embodiment of this operation is illustrated in FIG. 7. Located in front of the foot of the stay 9 is an annular locking mechanism 10 in which slides a latch 10.1. The latch 10.1 possesses a slot traversed by a retaining pin 10.3 fitted in the angular locking mechanism 10. The latch 10.1 features an axial bore which houses a tension spring 10.2. The latch 10.1 is fitted on its front end with an angular part. The angular part interacts with a wedge 1.1 attached to seat panel 1. These two parts, namely the annular part and wedge 1.1, have stop surfaces which bear on each other in the state illustrated according to FIG. 7. As is evident also, the rear end of latch 10.1 is opposed by a bore in the foot of the stay 9. In the state illustrated here, the latch 10.1 does not engage the bore.

In extending the seating device, so that seat panel 1 moves upward and thus away from base 2, wedge 1.1 retracts from angular part of latch 10.1 (i.e., the two stop faces disengage). At this moment, tension spring 10.2 can go into operational action. Tension spring 10.2 attaches with its rear end to stop pin 10 and with its front end to the latch 10.1. Tension spring, 10.2 causes the latch 10.1 to snap with its rear end into the bore in the foot of stay 9. Stay 9 is thus secured against disalignment or displacement. This retention is effective during the entire adjustment process and, of course, also in the extended state of seat panel 1.

Figure 8:
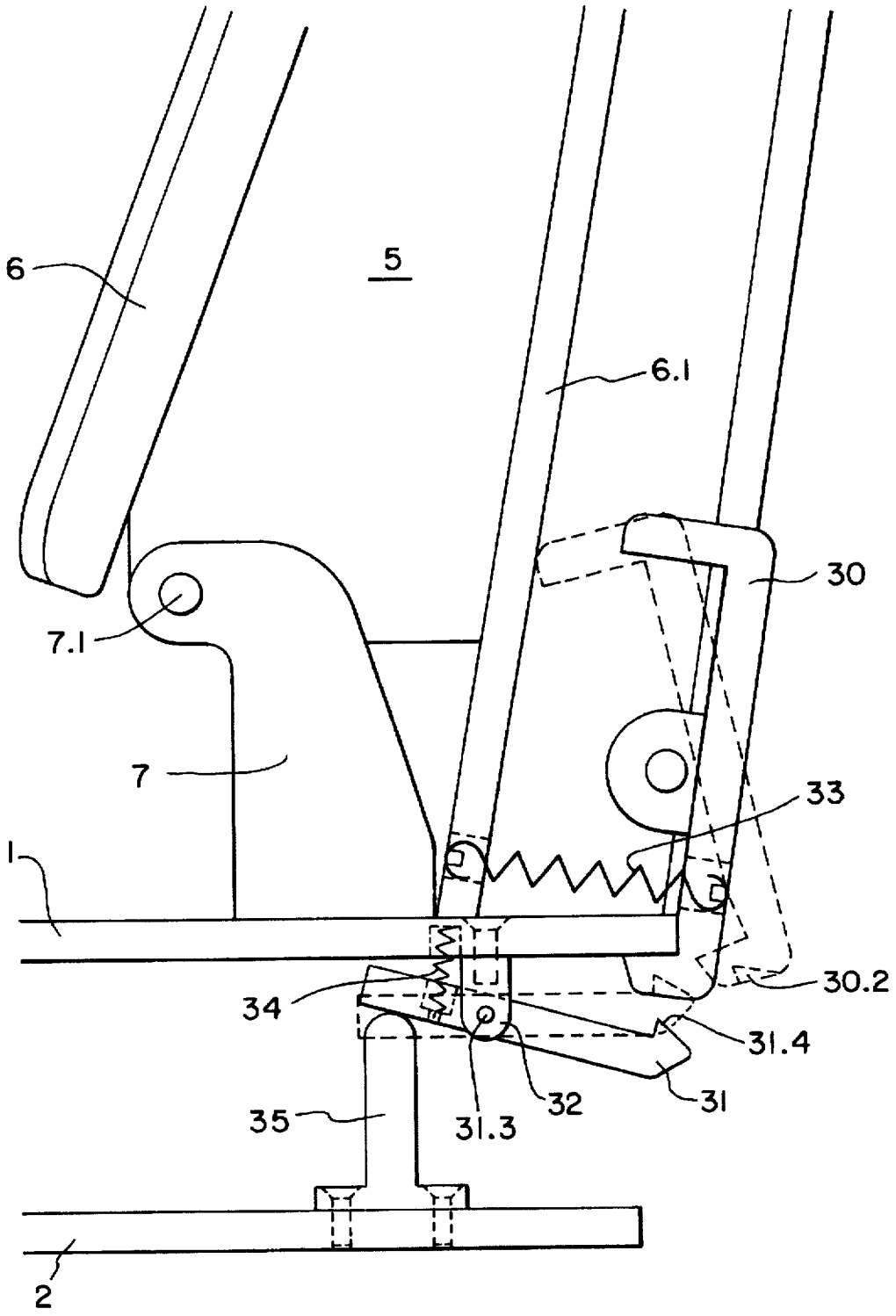
FIG. 8 is an enlarged view of an embodiment of a backrest safety device of the invention.

Another safety measure ensures that the backrest assembly is always retained in the same upright state and position. This backrest safety measure to prevent alteration of its inclination or tilting to the rear is illustrated in FIG. 8, showing the seating device in side elevation similar to the illustration relative to FIG. 1, but greatly scaled up and without rack 8 with stay 9. In detail, there are again the seat panel 1, the pivotal bracket 7 to which backrest assembly 5 is hinged by means of pivot axle 7.1, the guide channel 6.1 for receiving the stay, (not illustrated here) and lastly base 2.

Components include a rocker lever 30 rocking about a pivot axle 30.1 arranged on the guide channel 6.1 and additionally a pawl 31, pivoting about a pivot axle 31.3, where it is supported by a pillow block 32. Further major components are a tension spring 33, a compression spring 34 as well as a trip pin 35.

As is evident, the interaction of rocker lever 30 and pawl 31 is such that they are able to engage each other. Noteworthy are the wedged point 31.4 on the pawl 31 as well as the matching recess 30.2 in the rocker lever 30. Upon engagement of these two parts, the backrest assembly 5 is secured against forward foldover. Contrarily, with these two parts disengaged, the backrest assembly 5 allows forward foldover to the state shown in FIG. 6. The latter state is desirable whenever the seat panel 1 and base 2 need to approach each other. This disengagement takes place automatically as the seat panel 1 and base 2 approach each other, and at that, in that the front part of the pawl 31 strikes on the trip pin 35. It is also evident that the backrest safety feature according to FIG. 8 is usable also independently of the principal idea of the invention, i.e., rack and stay.

Figure 9:
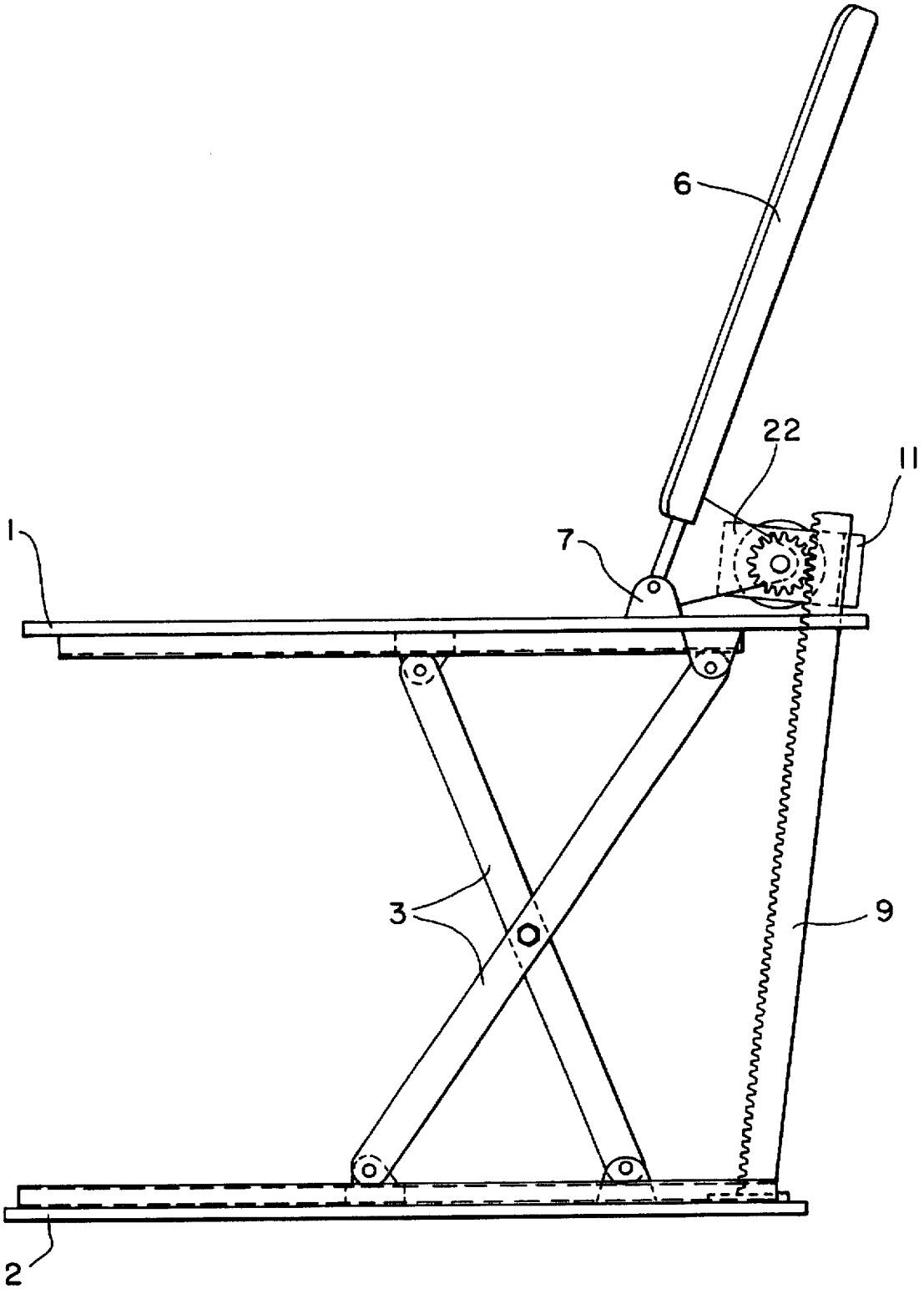
FIG. 9 is a side elevational view of another embodiment of the present invention.
Figure 10:
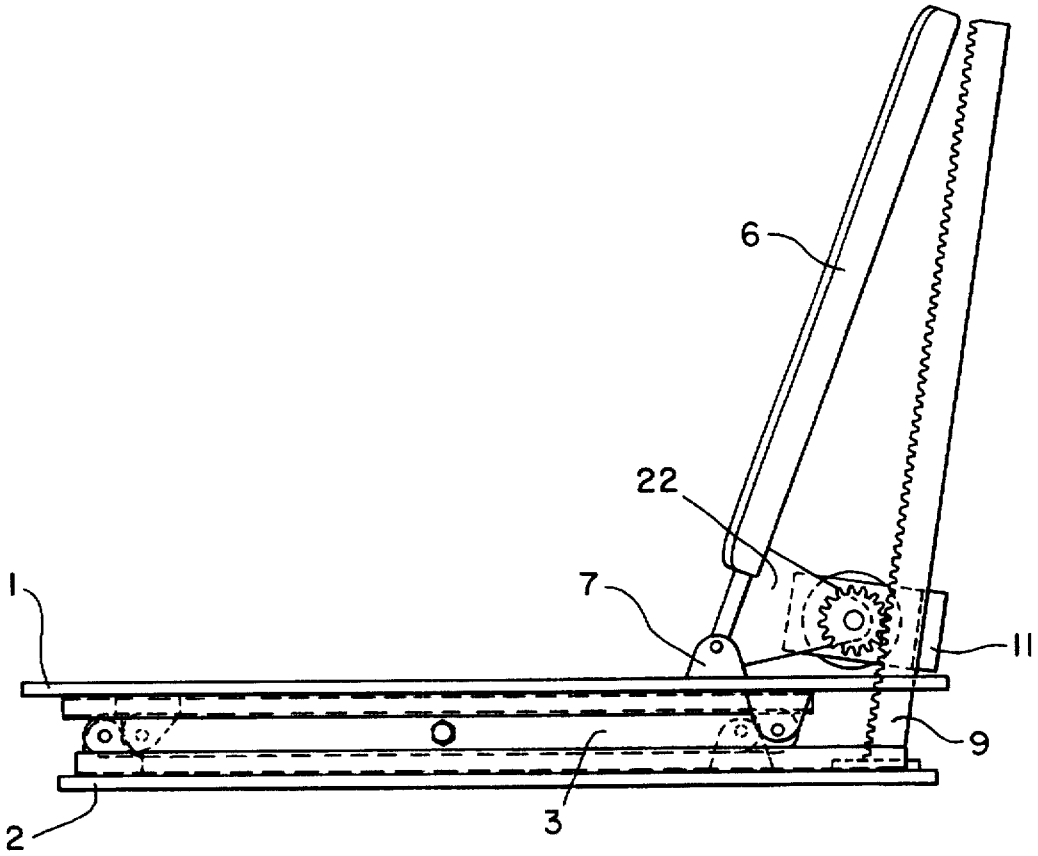
FIG. 10 is a side elevational view of the invention of FIG. 9 shown in the collapsed state.
Figure 11:
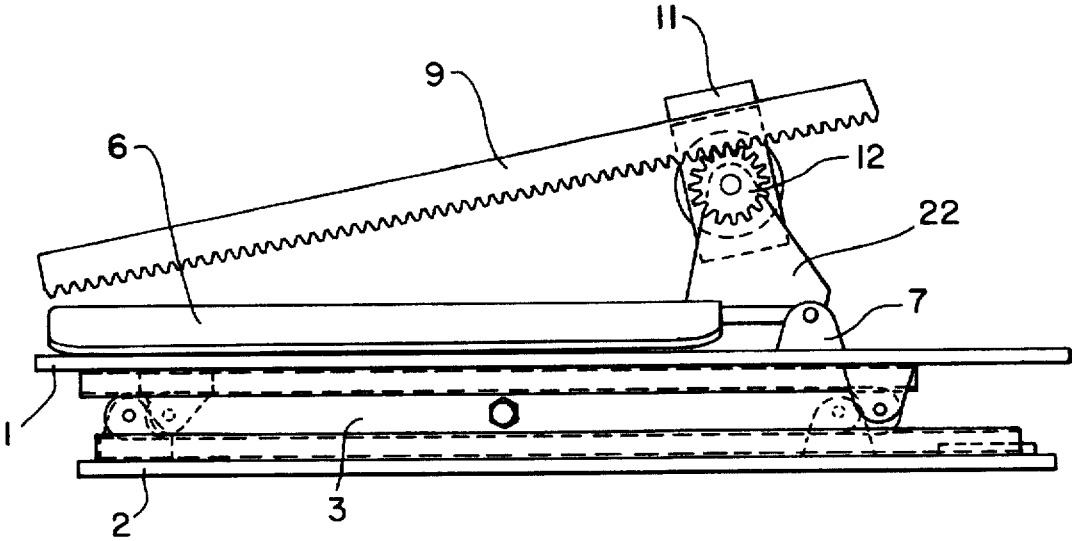
FIG. 11 is a side elevational view of the invention of FIG. 9 shown moving toward its folded state.

FIGS. 9, 10, and 11 show a further embodiment of the invention. The basic idea has been retained - namely, there is again a stay 9 which effects a change of distance between seat panel 1 and base 2, and thus the extension and collapsing of scissor frame 3. Additionally provided is a gearmotor 11 mounted on a console 22 driving a pinion 12. When the pinion 12 of FIG. 9 rotates counterclockwise, it moves down along stay 9, entraining seat panel 1 with the backrest 6 while the scissor frame 3 is collapsed. As opposed to the embodiment according to FIGS. 1 through 8, the articulated rack and the rack channel are absent here. The stay 9 itself is fashioned as a rack, while a guide channel is absent.

It is important that this embodiment shown in FIGS. 9, 10 and 11, retain the advantages of the invention fully and in their entirety. These advantages include an extremely simple, and thus lightweight construction, complete collapsibility to a small packet, and by increasing safety and comfort by the user during operation.

Figure 12:
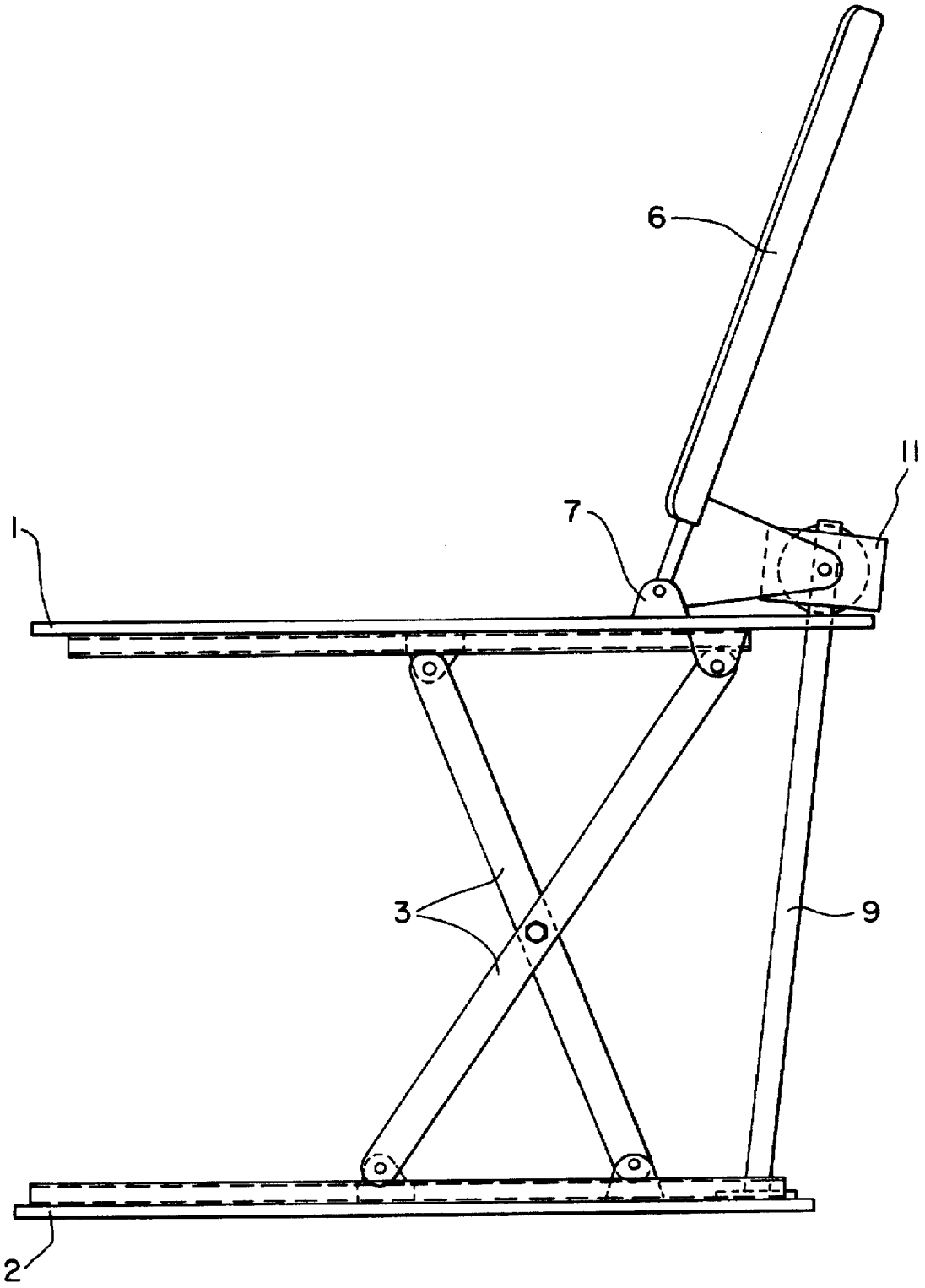
FIG. 12 is a side elevational view of another embodiment of the present invention.
Figure 13:
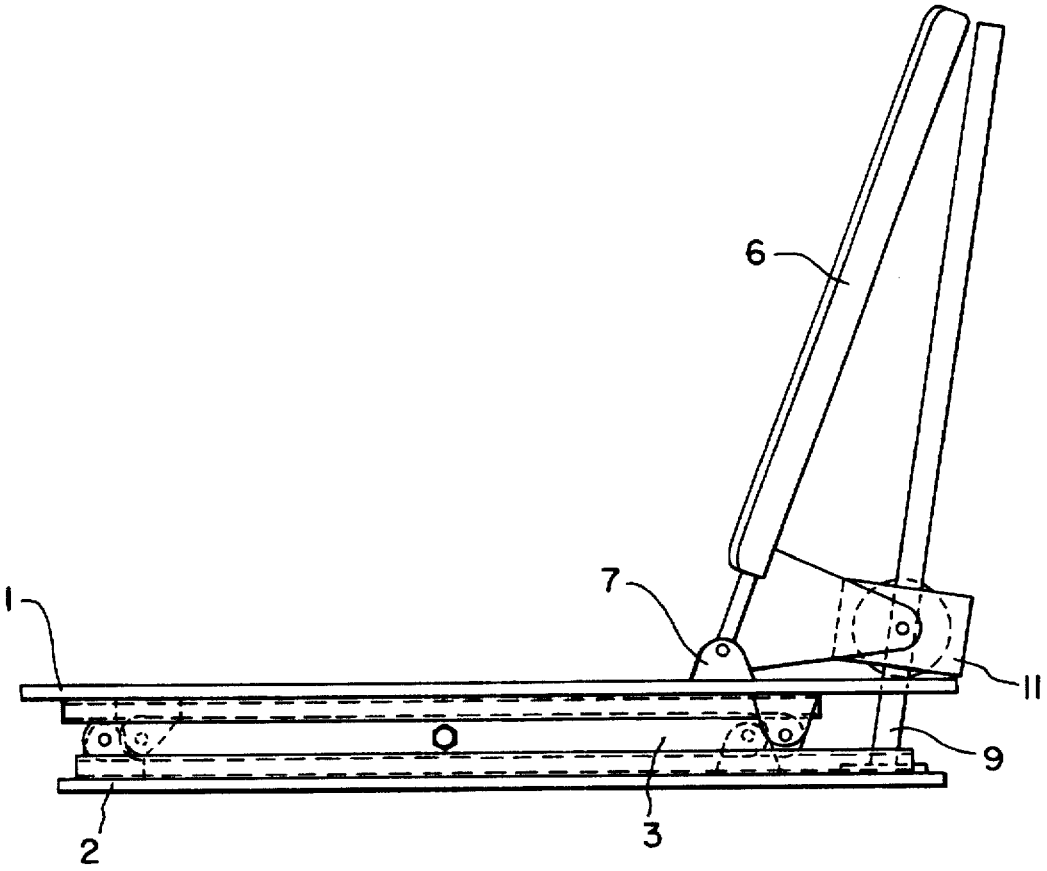
FIG. 13 is a side elevational view of the invention of FIG. 12 shown in the collapsed state.
Figure 14:
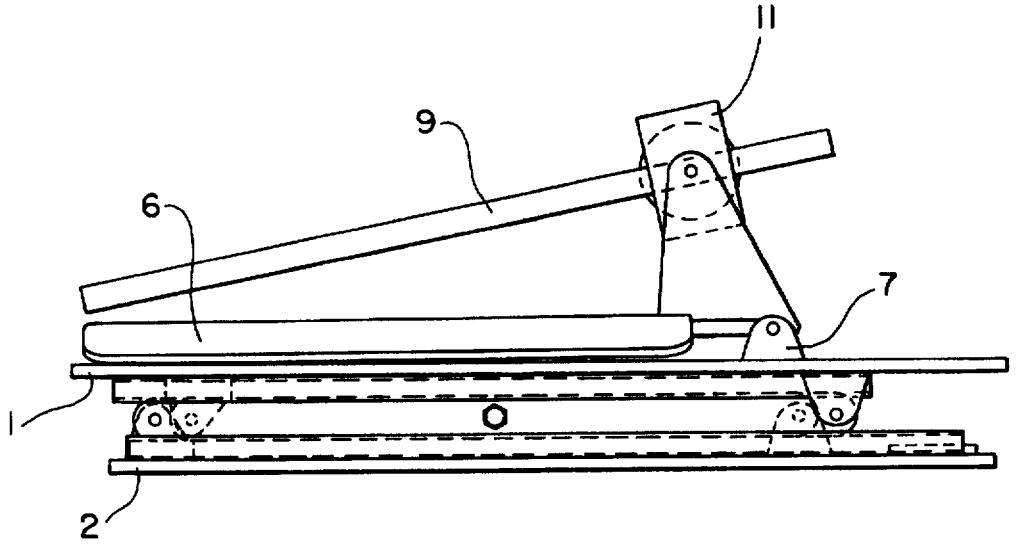
FIG. 14 is a side elevational view of the invention of FIG. 12 shown moving toward its folded state.

FIGS. 12, 13 and 14 show another embodiment of the invention. A stay 9 is again provided, but it is fashioned as a lead screw passing through a nut (not illustrated in detail). The nut, in turn, is in a stationary fashion fixed on seat panel 1, but driven by gearmotor 11, so that it travels up and down stay 9, entraining the seat panel 1 along with the backrest 6. FIG. 12 shows the extended state with seat panel 1 at maximum level, while FIG. 13 shows the retracted state in which the seat panel 1 and base 2 are in maximum proximity. FIG. 14 shows the collapsed state of the embodiment, ready for transportation.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A device for placement in a bathtub as an entering and exiting aid, the device comprising:

a seat having a seat panel that can be upwardly raised and downwardly lowered;

a backrest connected to said seat;

a drive for raising and lowering said seat panel;

an actuator arranged between said drive and said seat panel, said actuator including a stay which is attachable to said seat panel;

a pinion having teeth, said pinion driven by said drive; and a rack attached to an end of said stay, said rack including a rack channel and a plurality of rack segments having teeth, said rack segments storable in said rack channel, said teeth of said pinion mesh with said teeth of said rack segments, said drive, said pinion, and said rack channel arranged on said backrest above said seat panel; and said stay extendable downwardly from said seat panel so as to bear on a bearing surface, thereby effecting a raising of said seat panel that substantially matches said extension of said actuator.

2. The device of claim 1 further comprising a base and a scissor frame disposed between said seat panel and said base.

3. The device of claim 2 further comprising:

a pinion having teeth, said pinion driven by said drive; and a rack attached to an end of said stay, said rack including a rack channel and a plurality of rack segments having teeth, said rack segments storable in said rack channel, said teeth of said pinion mesh with said teeth of said rack segments, said drive, said pinion, and said rack channel arranged on said backrest above said seat panel.

4. The device of claim 3 which said rack channel includes an elbow arranged within said back rest.

5. The device of claim 1 in which said rack channel includes an elbow arranged within said back rest.

6. The device of claim 1 further including a locking mechanism for locking said stay to said seat to prevent unintended seat collapse.

7. The device of claim 6 in which said locking mechanism includes a latch which is released by upward movement of said seat panel in order to engage the lock of said stay, and which in the downward movement of said seat panel disengages from a lower area of said stay shortly before reaching the bottommost position of said seat panel.

8. The device of claim 1 further including a backrest safety device having an interengaging rocker lever and pawl connected to said backrest to latch said backrest and thereby prevent alteration of an inclination of said backrest.

9. The device of claim 8 in which said seat has a bearing surface comprising a base, and said backrest safety device includes:

a rocker lever pivotably attached to said backrest;

a pawl pivotably mounted to said seat panel; and a trip pin connected to said base to effect tripping of said pawl when said seat panel approaches said base.

10. The device of claim 1 in which said bearing surface comprises a base and said backrest safety device includes:

a rocker lever pivotably attached to said backrest;

a pawl pivotably mounted to said seat panel, said rocker lever engagable with said pawl; and a trip pin connected to said base to effect tripping of said pawl when said seat panel approaches said base.

11. The device of claim 10 in which said rocker is a lever pivotably attached to said backrest;

said pawl is mounted to said seat panel in a pivotable fashion; and said backrest includes a trip pin connected to said base to effect a mutual approach of said seat panel to said base in the tripping of said pawl.

* * * * *